US007320344B2

(12) United States Patent
Van Doormaal et al.

(10) Patent No.: US 7,320,344 B2
(45) Date of Patent: Jan. 22, 2008

(54) DEVICE FOR COMPACTING A FLOWABLE SOLID MATERIAL

(75) Inventors: Petrus Johannes Van Doormaal, Arendonk (BE); Hendricus Adrianus Mariën, Arendonk (BE)

(73) Assignee: Arodo BVBA, Arendonk (BE)

( * ) Notice: Subject to any disclaimer, the term of this patent is extended or adjusted under 35 U.S.C. 154(b) by 54 days.

(21) Appl. No.: 11/052,230

(22) Filed: Feb. 8, 2005

(65) Prior Publication Data

US 2005/0189032 A1 Sep. 1, 2005

(30) Foreign Application Priority Data

Feb. 9, 2004 (NL) ..... 1025445

(51) Int. Cl.
*B65B 1/04* (2006.01)

(52) U.S. Cl. ..... 141/12; 141/71

(58) Field of Classification Search ..... 141/301, 141/302, 67, 71–81, 114, 313, 12; 100/211, 100/90

See application file for complete search history.

(56) References Cited

U.S. PATENT DOCUMENTS 3,195,586 A 7/1965 Vogt
3,260,285 A 7/1966 Vogt
3,586,066 A 6/1971 Brown
3,788,368 A 1/1974 Geng et al.
5,711,215 A * 1/1998 Sextl et al. ..... 100/211

* cited by examiner

*Primary Examiner*—Steven O. Douglas
(74) *Attorney, Agent, or Firm*—Birch, Stewart, Kolasch & Birch, LLP

(57) ABSTRACT

A device and a method for compacting a flowable solid material have a compacting space provided with a supply opening for supplying material to be compacted to the compacting space and a discharge opening for discharging compacted material. A closure device for effecting a gastight seal of the compacting space and pressure device for creating a reduced pressure inside the compacting space in the hermetically sealed condition of the compacting space are provided. The pressure device can change the volume of the compacting space, and/or the compacting space comprises a first part for accommodating the material and a second part that can be sealed gastight from the first part by a further closure device, in which said second part the pressure can be reduced by the pressure device in the situation in which the second part is sealed gastight from the first part by the closure device.

21 Claims, 10 Drawing Sheets

DEVICE FOR COMPACTING A FLOWABLE SOLID MATERIAL

The invention relates to a device for compacting a flowable solid material, comprising a compacting space provided with a supply opening for supplying material to be compacted to the compacting space and a discharge opening for discharging compacted material from the compacting space, closure means for effecting a gastight seal of the compacting space and pressure means for creating a reduced pressure inside the compacting space in the hermetically sealed condition of the compacting space.

Such a device is used in particular for preparing the packaging of the flowable solid material so as to achieve a minimum volume thereof, and thus of the packaging, or at least a volume which is smaller than in the non-compacted condition of the flowable solid material, and/or in situations in which the material is to be packaged fully free from air (vacuum). Further advantages can be obtained as regards the stackability, the water-tightness and the storage life of the packages and/or the contents thereof.

BACKGROUND OF THE INVENTION

A device as referred to in the introduction is described in European application EP 1 312 547 A1 as forming part of a packaging line for a flowable material, such as cement. The compacting space thereof is formed by a container which is provided with a supply opening, which can be sealed gastight by means of a cover, at the upper side and with a discharge opening, which can be closed by means of a pivoted bottom, at the bottom side. Disposed above the supply opening is a metering device, by means of which a metered supply of flowable material to the container through the open supply opening can be effected with the discharge opening in its closed condition. After the container has been filled with flowable material to a desired extent, the supply opening cover closes, as a result of which the interior of the container is sealed gastight from its environment. A vacuum pump is connected to the container, by means of which air can be extracted from the container, thus creating a reduced pressure in the container. This has a compacting effect on the material in the container of itself already. This effect is enhanced by admitting air, whether or not quickly, to the container again, thus creating a pressure wave which has an additional compacting effect on the material in the container. After the material has thus been compacted, in which connection it is noted that said reduction of the pressure and said admission of air to the container again could also be repeated a few times in succession, the discharge opening is opened, after which the compacted material falls into a package, for example a bag, which is subjected to further processing.

An important problem that occurs when compacting flowable solid material is that usually dust formation takes place to some extent. Such dust is harmful for the vacuum pump that is used for reducing the pressure in the container in which the material to be compacted is present. Consequently it is necessary to use a filter system between the container and the vacuum pump. To increase the efficiency of such filter systems, it is necessary to use filters, preferably fine-meshed ones, and relatively large filter casings that need to be capable of withstanding the sub-atmospheric pressure that is generated. Consequently, the filter casings must be of relatively heavy construction. In addition, such a filter system reduces the efficiency with which the vacuum pump can effect the pressure reduction in the container, as a consequence of which it is necessary to use a vacuum pump of heavier construction as well. Another important drawback related to the use of filters systems is the fact that the dust filters used therein require a great deal of maintenance and need to be exchanged frequently. Usually it is necessary to clean the filter system very frequently, in some cases after every cycle, e.g. by using compressed air, knocking and/or vibrating. Said cleaning steps have a negative effect on the time during which a vacuum pump and the filter system can actually be operational, and thus on the cycle time.

It is noted that U.S. Pat. No. 3,260,285 describes an apparatus and a method for filling containers for pulverulent material, wherein use is made of a combination of a hopper, to the bottom side of which a chute section, a flow control valve and a filler including an upper magazine and a lower flow control head successively connect. In use, a container to be filled is connected gastight to the lower end of the flow control head. The inner side of the flow control valve is provided with a circumferential liner of a flexible material, on the outer side of which a space to be pressurized is present, which makes it possible to force the liner inwards so as to close the valve. The flow control head comprises a valve member, likewise made of a flexible material, which can be inflated inwardly so as to create a bottom for the filler that is to be filled. After a container has been connected gastight to the flow control head, the pressure outside the circumferential liner of the valve member is reduced, as a result of which the valve member will open and the pulverulent material that was present on the valve member functioning as a bottom will fall into the container, aided by a reduced pressure that is generated in the container via a vacuum line. In which a dust filter is mounted. Subsequently, the dust filter is cleared of dust again by pressure blowing.

BRIEF SUMMARY OF THE INVENTION

The object of the invention is to reduce the negative consequences of the dust formation that occurs during the pressure reduction in the compacting space to a significant extent or solve said problem altogether. In order to accomplish that object, the invention is in the first place characterized in that the pressure means comprise volume means for changing the volume of the compacting space. By opening and closing the compacting space gastight in suitable succession and changing the (free) volume of the compacting space, it is thus possible to reduce the pressure in the compacting space without making use of a traditional vacuum pump that communicates with the compacting space via a filter system. Thus, the need for a filter system has been obviated, which has a positive effect as regards the cost price and the constructional simplicity, but also as regards the operating costs of a compacting device.

A constructionally very advantageous embodiment is obtained if the volume means comprise a wall of the compacting space that can move in a direction of movement towards and away from the interior of the compacting space. When the movable wall is moved towards the interior of the compacting space, the volume of the compacting space will logically decrease. When subsequently the compacting space is sealed gastight and the movable wall is moved back from the interior of the compacting space, e.g. to its original position, which can be done by creating a reduced pressure on the side remote from the interior of the compacting space, for example, a reduced pressure will be created inside the compacting space.

It is preferable in this connection for the direction of movement to be oriented perpendicularly to the direction of movement of the material between the supply opening and the discharge opening, since it is the wall/walls between the supply opening and the discharge opening that is (are) most suitable for being constructed as (a) movable wall(s). In that case the presence of the material to be compacted in the container must not interfere with the movement of the wall/walls, of course.

Preferably, the compacting space is at least substantially cylindrical in shape between the supply opening and the discharge opening, with the diameter of the cylindrical shape at the location of the movable wall being larger in an outer position of said movable wall than the diameter of another part of the cylindrical shape. The cylindrical shape of the compacting space between the supply opening and the discharge opening fits in well with the rectilinear movement of the material to be compacted from the supply opening, through the compacting space, to the discharge opening during the compacting process. If the diameter of the cylindrical shape at the location of the movable wall is larger in an outer position of said movable wall than the diameter of another part of the cylindrical shape, it becomes possible to reduce the volume of the compacting space to a comparatively greater extent for the purpose of reducing the pressure in the compacting space.

In order to be able to effect a substantial pressure reduction in the compacting means by the volume means, the movable wall is preferably movable between an outer position and an inner position, in a direction perpendicular to the direction of movement of the material, over a distance of at least 25% of the dimension of the compacting space at the location of the movable wall.

The pressure-reducing capacity of the volume means can be increased even further if, in accordance with another preferred embodiment, the movable wall is movable from the outer position to the inner position to such an extent that the compacting space is shut off at least substantially completely at the location of the movable wall, in a plane perpendicular to the direction of movement of the material.

To prevent or at least significantly reduce any sealing problems that may result from the use of a movable wall, the movable wall preferably comprises an elastic material, preferably a rubber.

If a movable wall comprising an elastic material is used, it is furthermore advantageous if the movable wall is endless. This reduces the extent to which transitions are required between movable wall parts and non-movable wall parts, at which transitions problems might arise with regard to the gastight sealing of the compacting space.

As an alternative to volume means comprising a movable wall, the volume means preferably comprise an element that can be inflated inside the compacting space. Concretely, a balloon or the like may be considered in this connection. By Inflating an inflatable element inside the compacting space, the free volume of the compacting space is reduced and it becomes possible to reduce the pressure inside the compacting space in a manner comparable to the manner in which the pressure is reduced by means of a movable wall.

Preferably, the inflatable element can be inflated so that the circumference of the inflatable element abuts against walls of the compacting space. On the one hand a maximum pressure-reducing effect is thus achieved by means of the inflatable element, whilst in addition the inflatable element can function as a closure within the compacting space.

Furthermore, the compacting space preferably comprises a first part for accommodating the material to be compacted and a second part whose volume can be changed by the volume means.

To obtain greater independence as regards that which takes place in said first part and said second part, the compacting space is furthermore preferably provided with closure means for realising a gastight seal between said first part and said second part. This makes it possible, for example, to carry out the pressure reduction in a number of steps and/or to have the filling of the first part take place simultaneously with the reduction of the pressure in the second part.

It is noted within this framework that an additional advantage of the use of said further closure means for providing a gastight seal between the first part and the second part is the fact that the reduction of the pressure in the second part in the situation in which said second part is sealed from said first part by said further closure means will not lead to dust formation from the first part, where the material to be compacted is present, to the second part on account of the gastight seal that is provided between the first part and the second part by the closure means. This implies that in such a situation the pressure reduction In the second part can be realised not only by making use of volume means but also by making use of a traditional vacuum pump as already used in prior art compacting devices, whether or not in combination with a filter system arranged between said vacuum pump and said second part. After all, since the reduction of the pressure in the second part by means of a vacuum pump will not lead to dust formation from the first part to the second part if the first part and the second part are sealed from each other, it is not objectionable, at least not to the same extent as in the prior art, to use a vacuum pump for reducing the pressure. If a filter system should appear to be necessary, the required capacity thereof would normally be significantly lower than that of the filter systems used in comparable prior art devices. Within the framework of the foregoing, the invention further relates to a device for compacting a flowable solid material, comprising a compacting space provided with a supply opening for supplying material to be compacted to the compacting space and an outlet opening for discharging compacted material from the compacting space, closure means for effecting a gastight seal of the compacting space and pressure means for creating a reduced pressure inside the compacting space in the hermetically sealed condition of the compacting space, which device is at characterized in that the compacting space comprises a first part for accommodating the material and a second part that can be sealed gastight from the first part by further closure means, and in that the pressure inside said second part can be reduced by the pressure means in the situation in which the second part is sealed gastight from the first part by the closure means.

A very practical and compact embodiment is obtained if the second part forms a passage for material to be compacted moving from the supply opening to the first part.

Furthermore, the second part preferably forms at least one branch of the compacting space insofar as It extends between the supply opening and the discharge opening. Thus there is no need for the material to be compacted to move from the supply opening to the first part via the second part. This implies that the reduction of the pressure in the second part, or at least the reduction of the volume of the compacting space in the second part, can take place simultaneously with the filling of the first part with material to be compacted. If a number of branches are used, said branches may be arranged in a star-like configuration round the compacting space insofar as it extends between the supply opening and the discharge opening. It will be apparent to those skilled in the art that the number of branches and of course the dimension thereof determine the pressure-reducing capacity in the compacting space.

Furthermore, the second part is preferably present on the side of the first part that faces towards the discharge opening. This preferred embodiment may in particular be used in situations in which use is made of said further closure means between the first part and the second part as explained above. An important advantage of this preferred embodiment is the fact that the material to be compacted need not pass the second part in order to get into the first part. This makes it possible to reduce the pressure in the second part, or at least reduce the volume thereof, whilst simultaneously filling the first part with the material to be compacted. Once the first part has been filled with the material to be compacted and the pressure in the second part has been reduced, the further closure means can be opened so as to place the first part and the second part into communication with each other. If the first part is positioned above the second part, the material will fall from the first part into the second part under the influence of the force of gravity, or it may even be sucked into said second part. This has an additional compacting effect on the material.

The invention also relates to a method for using a device according to the first aspect of the invention, comprising the steps of:

A filling the compacting space with a flowable solid material to be compacted via the supply opening, B reducing the volume of the compacting space by making use of the volume means, C sealing the compacting space gastight by making use of the closure means, D enlarging the volume of the compacting space in the situation in which said compacting space is sealed gastight, thus reducing the pressure in the compacting space, E discharging the compacted flowable solid material from the compacting space via the discharge opening.

In principle, steps A and B may be carried out in the reverse order. In some situations this may even be preferable with a view to achieving a short cycle time.

To obtain an additional compacting effect, the method according to the invention preferably comprises the step of quickly admitting air into the compacting space, which step is preferably carried out between steps D and E, for the purpose of increasing the pressure in the compacting space, normally to atmospheric pressure.

Further preferably, the volume of the material to be compacted is maximally 50% of the volume of the compacting space. Thus, the volume of the part of the compacting space in which no material to be compacted is present is still substantial, so that a substantial pressure reduction can also be realised by reducing the volume of the part of the compacting space in which no material to be compacted is present, and subsequently increasing said volume again.

Especially if flowable solid material to be compacted has already been subjected to a first compacting operation in a first step, for example in a manner according to the present invention, it is preferable to charge the material to be (further) compacted into a bag in the compacting space during step A. Said bag will be the bag into which the material to be compacted is deposited after a first compacting step. The possibility that entrapped air will nevertheless be present in the bag cannot be ruled out in that case. Said entrapped air can be removed in the second step by means of the present preferred embodiment for the purpose of further compacting the material to be compacted.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

The invention will now be explained in more detail by means of a description of a number of preferred embodiments of a compacting device according to the invention. In which reference is made to FIGS. 1-10*c*, which schematically show a number of different embodiments of compacting devices according to the invention, with reference to which figures also the method according to the invention will be explained.

Figure 1:
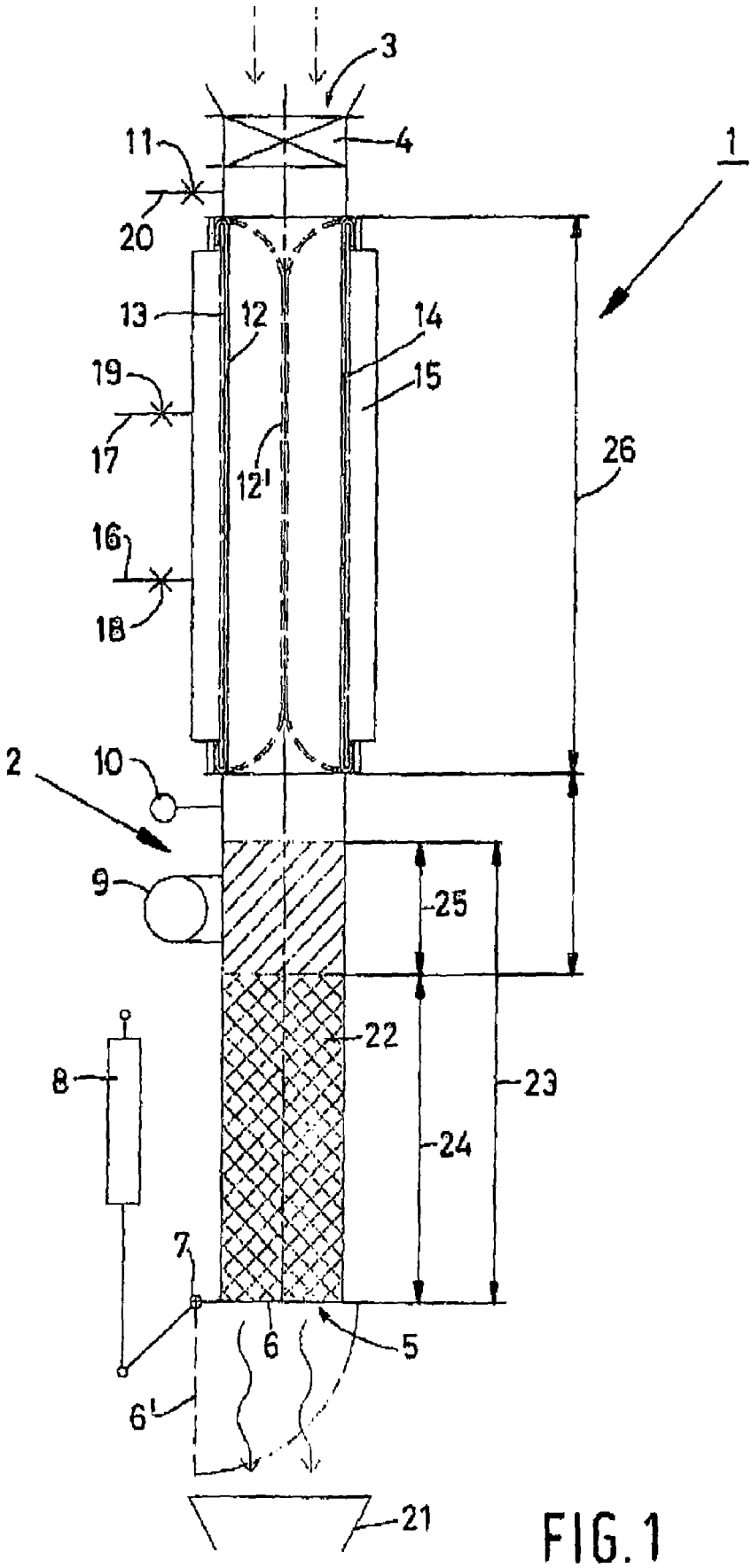
FIG. 1 is a schematic view showing a one embodiment of the compacting device of the present invention.

FIG. 1 shows a compacting device 1 for compacting a powdery material. The compacting device 1 comprises a vertically oriented cylindrical housing 2, at the upper side of which a supply opening 3 is present, which can be closed by the butterfly valve 4, and at the bottom side of which a discharge opening 5 is present, which can be closed by the bottom valve 6, which is shown in its open position, illustrated in a broken line 6' in FIG. 1, and which can be pivoted about the pivot 7 and by the cylinder-piston assembly 8. A vibrating unit 9 is connected to the housing 2, by means of which the housing 2 can be set vibrating. A pressure gauge 10 is provided for measuring the pressure in the interior of the housing 2. A valve 11 is mounted in the airline 20 near the butterfly valve 4, via which valve air can exit the interior of the housing 2, also in the closed position of the bottom valve 6 and the butterfly valve 4.

In the upper part of the housing 2, the inner wall is formed by a circumferential bellows 12, which is made of a flexible material, such as rubber. On the outer side, the bellows 12 is surrounded by a tube 13, which is circumferentially provided with various radial holes 14. Present at the outer side of the tube 13 is a cylindrical pressure chamber 15, to which an air discharge line 16 is connected, which air discharge line is in communication with a vacuum pump (not shown) and an air supply line 17, which is connected to a compressor or fan (not shown). Shut-off valves 18, 19, respectively, are provided in the air discharge line 16 and the air supply line 17.

By increasing the pressure in the pressure chamber 15, which is done by supplying air via the air supply line 17 in the open position of the shut-off valve 19 and the closed position of the shut-off valve 18, the bellows 12 is pressed radially inwards by the air as far as the central axis of the housing 2, so that the passage between the supply opening 3 and the discharge opening 5 is shut off by the bellows 12. This position of the bellows 12 is indicated at 12' in FIG. 1. Subsequently, the bellows 12 is allowed to return to its original position, in which the bellows 12 abuts against the inner side of the tube 13, by opening the shut-off valve 19 and closing the shut-off valve 18.

A metering device (not shown) is disposed above the supply opening 3 of the compacting device 1 for the metered supply of powdery material to the housing 2. Present under the discharge opening of the compacting device 1 is a package to be filled with the powdery material, such as a bag, and a funnel 21 is provided so as to ensure that the material that exits the housing 2 via the discharge opening 5 will actually land in the package in question. By way of illustration, reference is made also in this connection to European application EP 1 312 547 A1, more specifically to the description of the left-hand upper part of FIG. 1 thereof.

The compacting device 1 functions as follows. In a closed position of the bottom valve 6 and an open position of the butterfly valve 4, powdery material 22 metered by the metering device disposed above the supply opening 3 is deposited into the housing 2. Inside the housing 2, said material extends along the height indicated at 23. The material 22 consist of a solid fraction 24 and an air fraction 25. To compact the material 22, the air fraction 25 must be removed from the material 22 as much as possible so that the powdery material can take up less space.

After the powdery material 22 has been deposited into the housing 2, the bellows 12 is inflated in inward direction by supplying air to the pressure chamber 15 via the air supply line 17. As a result, air will escape from the housing 2 either via the butterfly valve 4, when the butterfly 4 is still open, or via the air discharge line 20 in the open position of the valve 11 when the butterfly valve is closed. Once the bellows 12 is completely inflated, after which the valves 4, 11 and 19 are closed, insofar as such is not the case yet, the pressure in the pressure chamber 15 is reduced by opening the shut-off valve 18, as a result of which the bellows 12 is drawn against the tube 13 again. As a result, the interior volume of the housing 2 is enlarged, and because of the fact that the interior of the housing 2 is shut off from the environment of the housing 2, a reduced pressure is created within the housing 2 without dust finding its way into the environment. The magnitude of the reduced pressure can be read from the pressure gauge 10. By (quickly) opening the butterfly valve 4 or the valve 11 from this reduced pressure condition inside the housing 2, air is admitted into the housing 2, resulting in a pressure wave that causes the material 22 to be compacted, insofar as said compacting had not already taken place as a result of the pressure reduction within the housing 2.

The material 22 thus compacted is removed from the housing 2 by opening the bottom valve 6. The compacted material 22 falls into the appropriate package via the funnel 21 under the influence of the force of gravity. The vibrating unit 9 may be used to facilitate said filling of the material 22 into the package.

By way of background information it is noted that the following relation applies:

$$V = \frac{1-G}{G} \cdot R$$

wherein

V=the capacity of the compacting space

R=the volume of the amount of air to be removed

G=the desired absolute final pressure (BAR)

Figure 2:
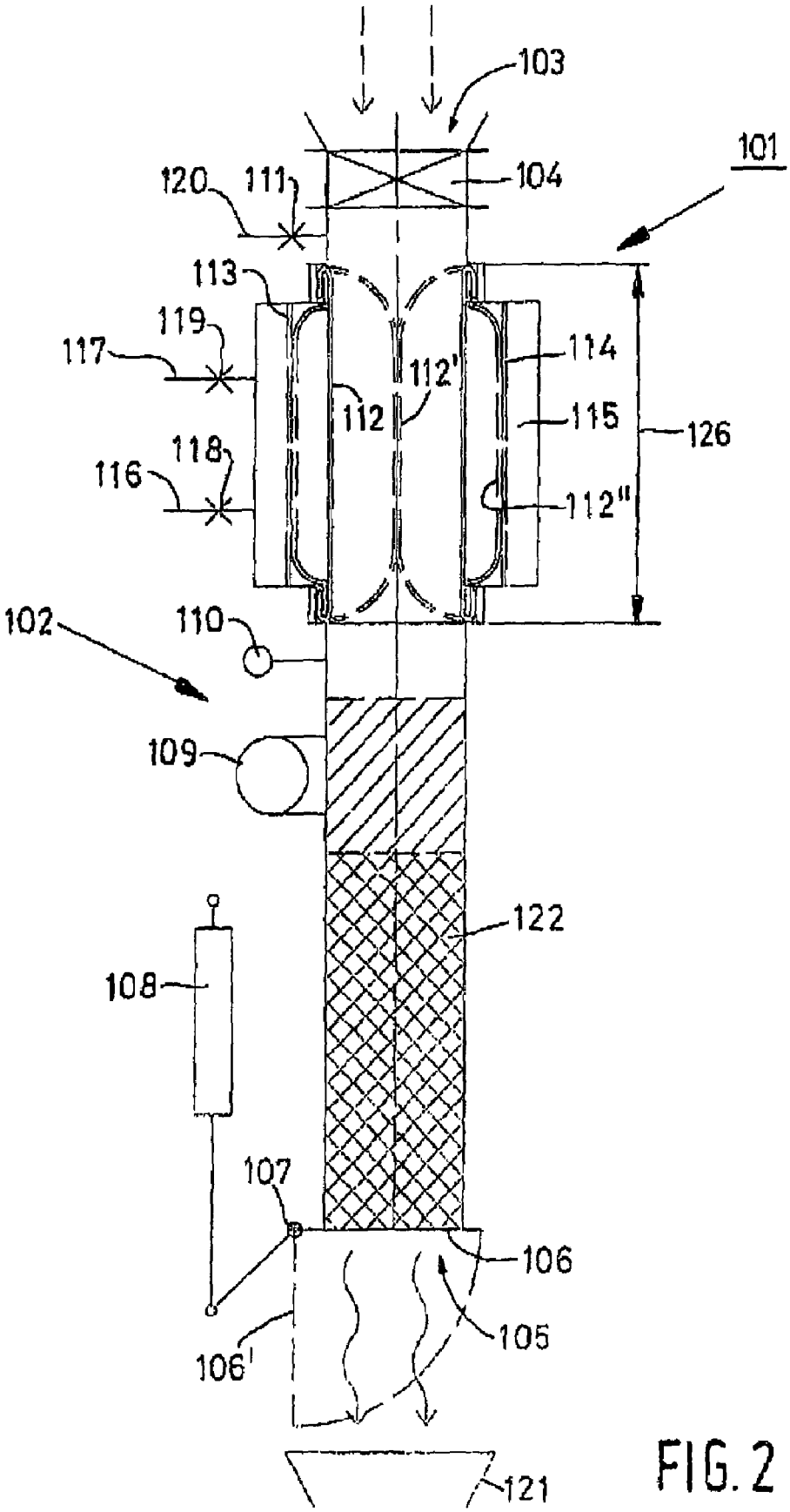
FIG. 2 is a schematic view showing another embodiment of the compacting device of the present invention.

The compacting device 101 that is shown in FIG. 2 is quite similar to the compacting device 1 that is shown in FIG. 1. For that reason, like parts are indicated by the same numerals as in FIG. 1, augmented by 100. The description below of FIG. 2 concerns only those aspects of the compacting device 101 that are different from the compacting device 1. The differences are to be found in the bellows 112 and the parts surrounding said bellows. The diameter of the tube 113 is larger than that of the remaining part of the housing 2, which enables the bellows 112 not only to deform radially inwards, as indicated by 112', but also radially outwards, as indicated by 112", into abutment with the inner side of the tube 113. As a result, a smaller overall height 26, 126 will suffice in order to retain the same pressure-reducing capacity within the housing 2. This is advantageous, of course, in connection with the required amount of space and the required minimum height of the metering device above the compacting device 1, 101. The compacting device 101 functions in substantially the same manner as the compacting device 1. Once the housing 102 is filled with powdery material 122, the bellows 112 is inflated radially inwards to the position 112', after which the interior of the housing 102 is sealed airtight from its environment and the bellows 112 is drawn radially outwards to the position 112" by reducing the pressure in the pressure chamber 115. The extent to which the volume of the interior of the housing 102 is increased is indicative of the pressure reduction that can thus be effected within the housing 102. In turn, said pressure reduction is indicative of the magnitude of the pressure wave that is realised by opening the valve 104.

Figure 3:
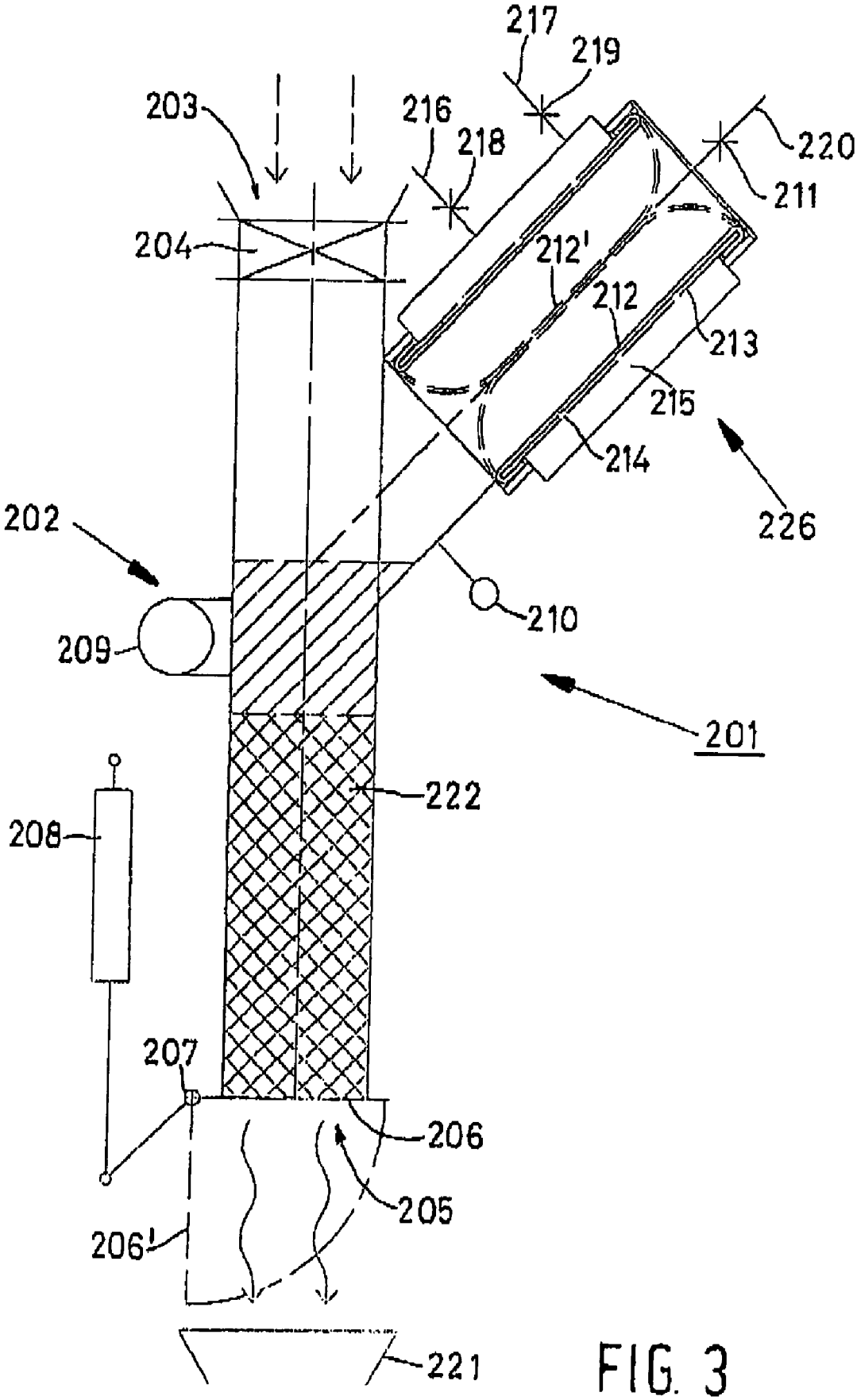
FIG. 3 is a schematic view showing another embodiment of the compacting device of the present invention.

Insofar as applicable, the reference numerals used in the description of the compacting device 201 of FIG. 3 correspond to the numerals used in FIG. 1, augmented by 200. The compacting device 201 is different from the compacting device 1 in that the former device is provided with a branch 226, in which the bellows 212 and the associated elements 213-219 are accommodated. Thus, powdery material will not pass the bellows 212 on its way from the supply opening 203 to the discharge opening 205. Although the diameter dimensions of the branch 226 and the part of the housing 202 that extends between the supply opening 203 and the discharge opening 205 are substantially identical in the present embodiment as shown in FIG. 3, the use of a branch, such as the branch 226, provides greater freedom of design in arriving at a desired pressure-reducing capacity. In this connection it is noted, for example, that it would also be possible for the branch 226 to be oriented horizontally instead of diagonally, e.g. in order to reduce the overall height, and for the branch 226 to have a considerably larger diameter, so as to increase the pressure-reducing capacity, or to provide a number of branches 226, e.g. arranged in a star-like configuration around the part of the housing 202 extending between the supply opening 203 and the discharge opening 205.

Figure 4:
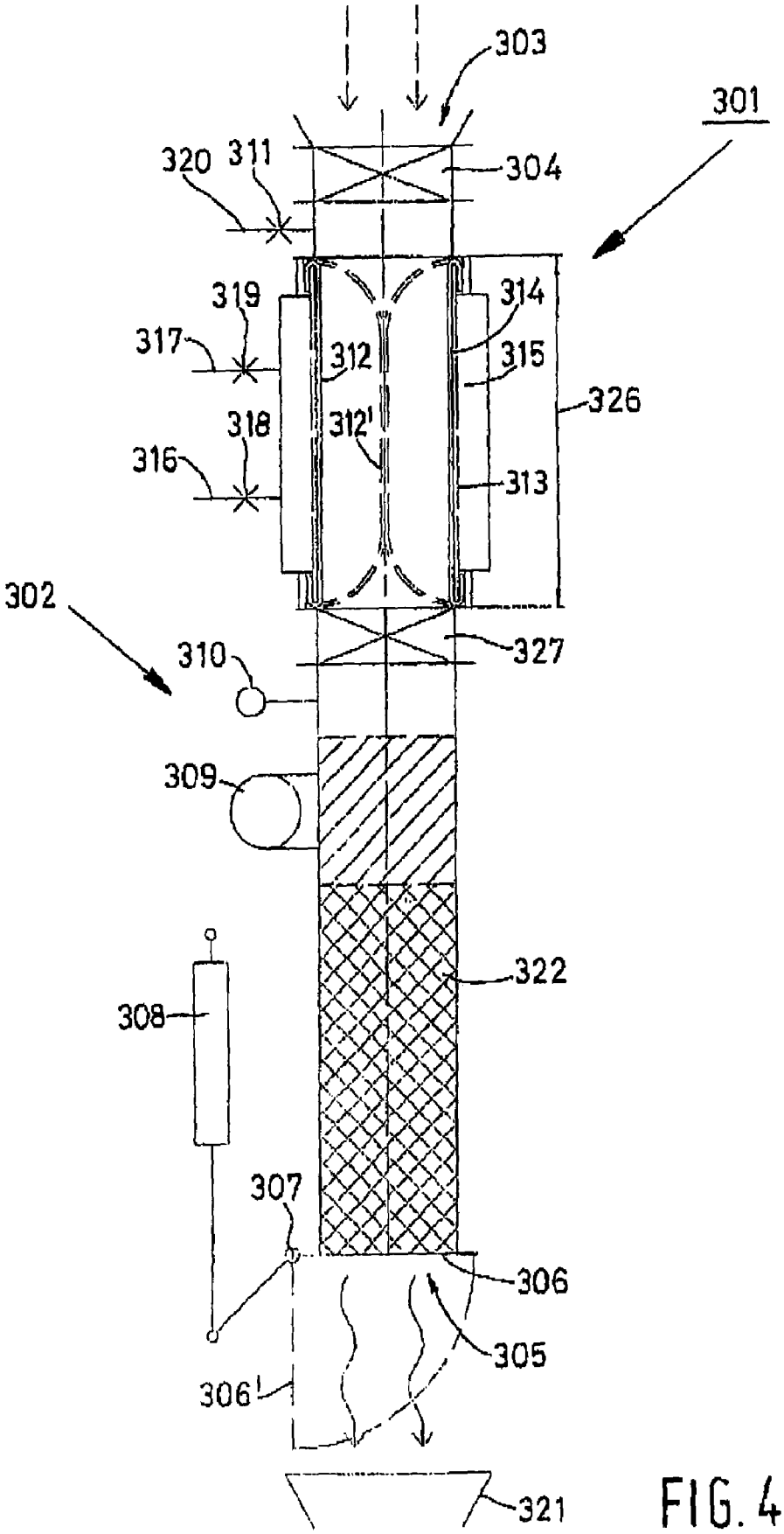
FIG. 4 is a schematic view showing a further embodiment of the compacting device of the present invention.

The reference numerals used for the description of the compacting device 301 of FIG. 4 correspond to the numerals used in FIG. 1, augmented by 300. An important feature of the compacting device 301 is the butterfly valve 327 that is disposed between the bellows 312 and the lower part of the housing 302 where powdery material 322 is present after being deposited Into the housing 302. The use of the butterfly valve 327 makes it possible to reduce the pressure inside the housing 302 in several steps. This has the advantage that a smaller height 326 of the bellows 312 will suffice in order to eventually obtain a specific desired pressure reduction inside the housing 302.

The compacting device 301 functions as follows. After material 322 has been deposited into the housing 302, the bellows 312 is Inflated radially inwards, after which the housing 302 is sealed airtight from its environment. Subsequently, the bellows 312 is drawn radially outwards against the tube 313, as a result of which the volume of the interior of the housing 302 increases and consequently the pressure within the housing 302 decreases. If the pressure within the housing 302 has not been reduced to a sufficient extent, the butterfly valve 327 is closed so as to maintain the reduced pressure between the butterfly valve 327 and the bottom valve 306, after which the valve 311 and/or the butterfly valve 304 is (are) opened and the bellows 312 is inflated again, the valves 311, 304 are closed and the bellows 312 is drawn against the tube 313 again. By subsequently opening the butterfly valve 327, the pressure for the material 322 can be further reduced, provided of course that the pressure that prevails between the butterfly valve 327 and the butterfly valve 304 before the butterfly valve 327 is opened its lower than the pressure that prevails between the butterfly valve 327 and the bottom valve 306 at that moment. This process can be repeated until the desired pressure is reached Inside the housing 302, after which the butterfly valve 304 (or the valve 311) is opened, in the open position of the butterfly valve 327, so as to effect a pressure wave as described before in the housing 302 and thus compact the powdery material 322.

Figure 5:
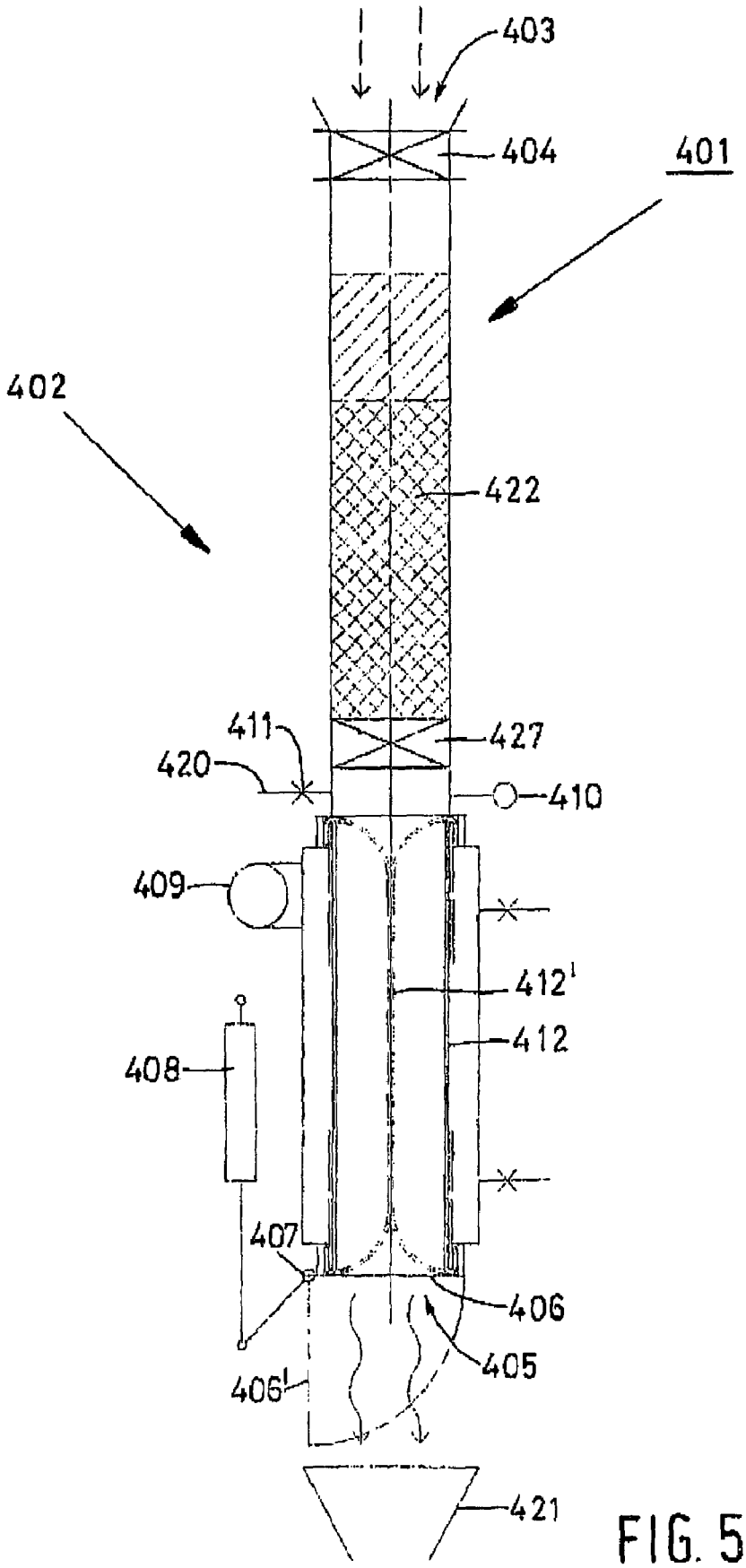
FIG. 5 is a schematic view showing a further embodiment of the compacting device of the present invention.

The use of an (additional) butterfly valve furthermore makes it possible to place the bellows below rather than above the material to be compacted, as is illustrated by means of the compacting device 401 in FIG. 5, in which like parts are indicated by corresponding numerals, augmented by 400. The compacting device 401 comprises an intermediate butterfly valve 427 approximately halfway the height of the housing 402. Disposed between the bottom valve 406 and the intermediate valve 427 is a bellows 412.

The compacting device 401 functions as follows. In the closed position of the intermediate valve 427 and the bottom valve 406, the pressure in the interior of the housing 402 between the aforesaid valves is reduced by inflating the bellows 412 (412'), during which process air can escape via the open valve 411 and the air discharge line 420. Subsequently, the pressure is reduced by drawing the bellows 412 against the tube 413 again. The construction of the valve 411 as a one-way valve makes it possible to repeat this process until the pressure gauge 410 shows that a desired reduced pressure has been reached in the housing 402, in the part that extends between the intermediate bottom valve 406 and the intermediate valve 427. Simultaneously with said pressure reduction, the part of the housing 402 above the intermediate valve 427, in which the valve 427 functions more or less as a bottom, can be filled with powdery material 422 to be compacted via the supply opening 403 in the open position of the butterfly valve 404. It is noted in this connection that the reduction of the pressure, as effected inter alia by the bellows 412, and the filling of the housing 402 with material 422 may take place simultaneously, which has a positive effect on the cycle time. After the housing 402 has been filled with material 422 and a desired reduced pressure has been realised between the intermediate valve 427 and the bottom valve 406, the valve 427 is opened, as a result of which material 422 is sucked downwards, causing the material 422 to be compacted. This effect can be further enhanced if the butterfly valve 404 is in its closed position when the intermediate valve 427 is opened and is not opened until the material 422 has landed on the bottom valve 406, as a result of which a shockwave is produced.

Figure 6:
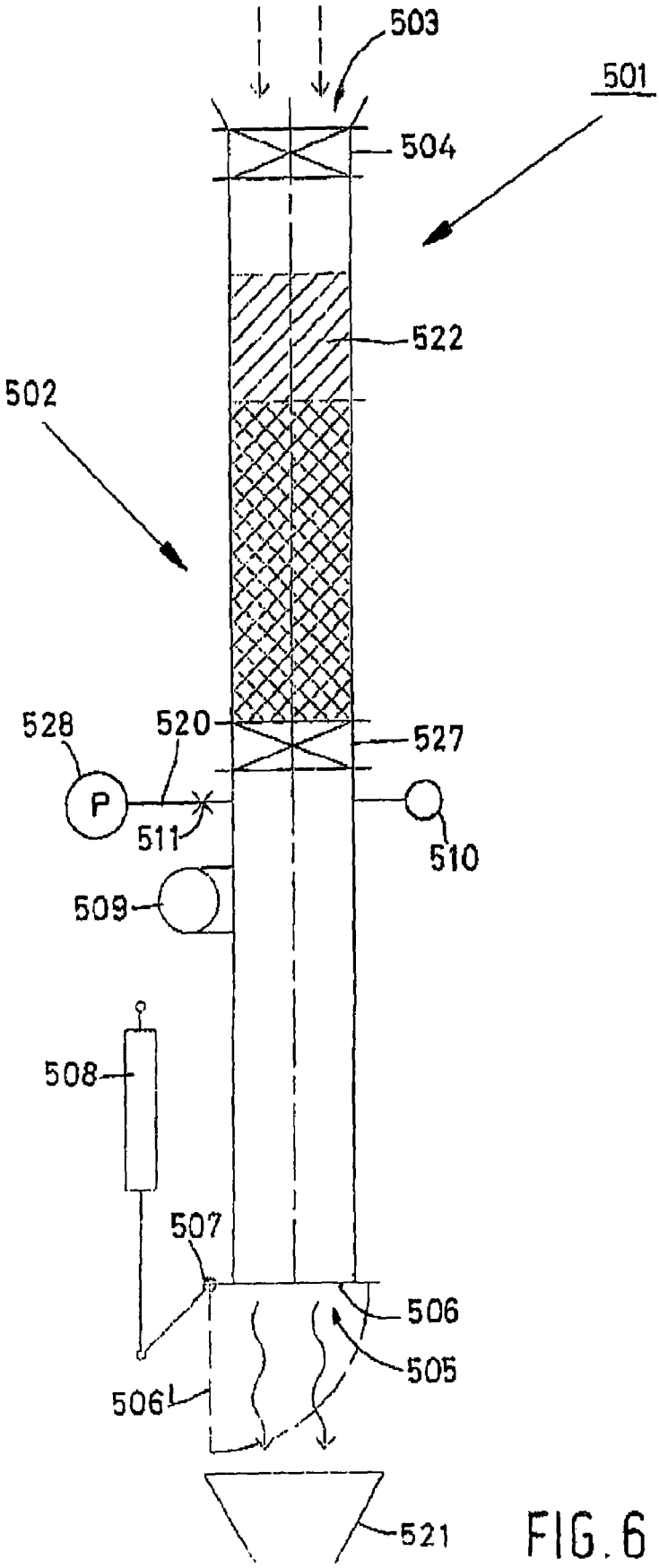
FIG. 6 is a schematic view showing yet another embodiment of the compacting device of the present invention.

As those skilled in the art will recognise, no dust formation will take place in the space between the intermediate valve 427 and the bottom valve 406 in the compacting device 401 upon creation of a reduced pressure therein, since said space is separated from the material 422 to be compacted by the intermediate valve 427. This also implies that the drawbacks of the prior art, viz. the fact that such dust formation affects the vacuum pump and that all kinds of constructional measures must be taken to protect the vacuum pump, do not apply in the case of the compacting device 1, not even if said reduced pressure is created by means of a conventional vacuum pump rather than by means of a bellows. An example of such a compacting device is shown in FIG. 6 in the form of the compacting device 501. In FIG. 6, the same numerals are used as in FIG. 5, augmented by 100. The compacting device 501 is in large measure similar to the compacting device 401. No bellows are used for increasing the pressure between the intermediate valve 527 and the bottom valve 506, however, but instead a traditional vacuum pump 528 is used, which communicates with the interior of the housing 502 via the air discharge line 520.

Figure 7:
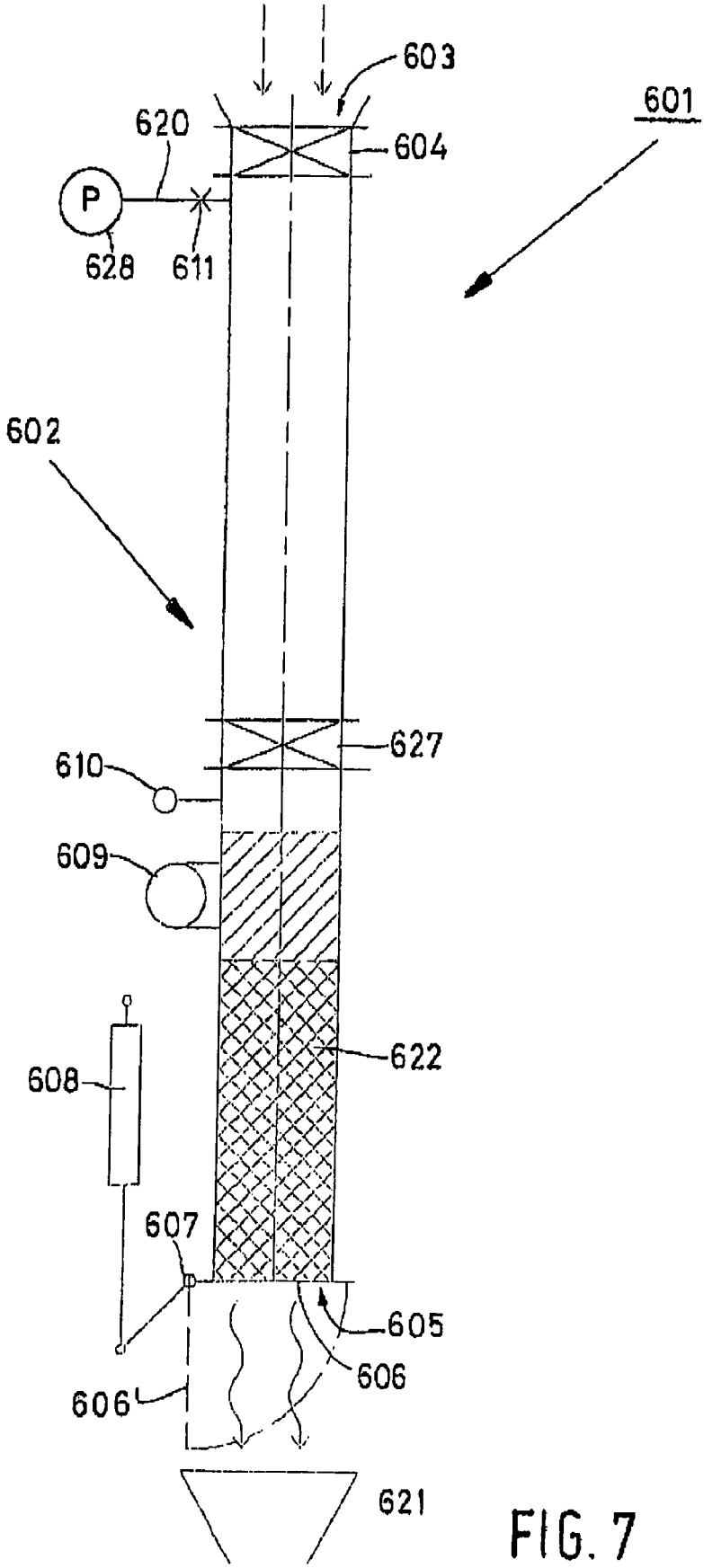
FIG. 7 is a schematic view showing another embodiment of the compacting device of the present invention.

In the compacting device 601 as shown in FIG. 7, precisely the reverse division is used between the space in which the reduced pressure is created and the space in which the material to be compacted is (initially) received in the container 602, said division in fact being the same as in the compacting device 301 as shown in FIG. 4. The reference numerals used in FIG. 7 correspond to the numerals used with the compacting device 301 of FIG. 4, augmented by 300. In this embodiment, the reduced pressure in the housing 602 between the butterfly valve 604 and the intermediate valve 627 is not effected by means of a bellows but by means of a traditional vacuum pump 628, which is connected to the interior of the housing 602 via the air discharge line 620. Since the intermediate valve 627 provides a seal between the material 622 to be compacted and the space in which the pressure is (initially) reduced by means of the vacuum pump 628, there is no risk of dust formation from the material 622 to be compacted during said pressure reduction and of said dust reaching the pump 628. The operation of the compacting device 601 further corresponds to that of the compacting device 301.

Figure 8:
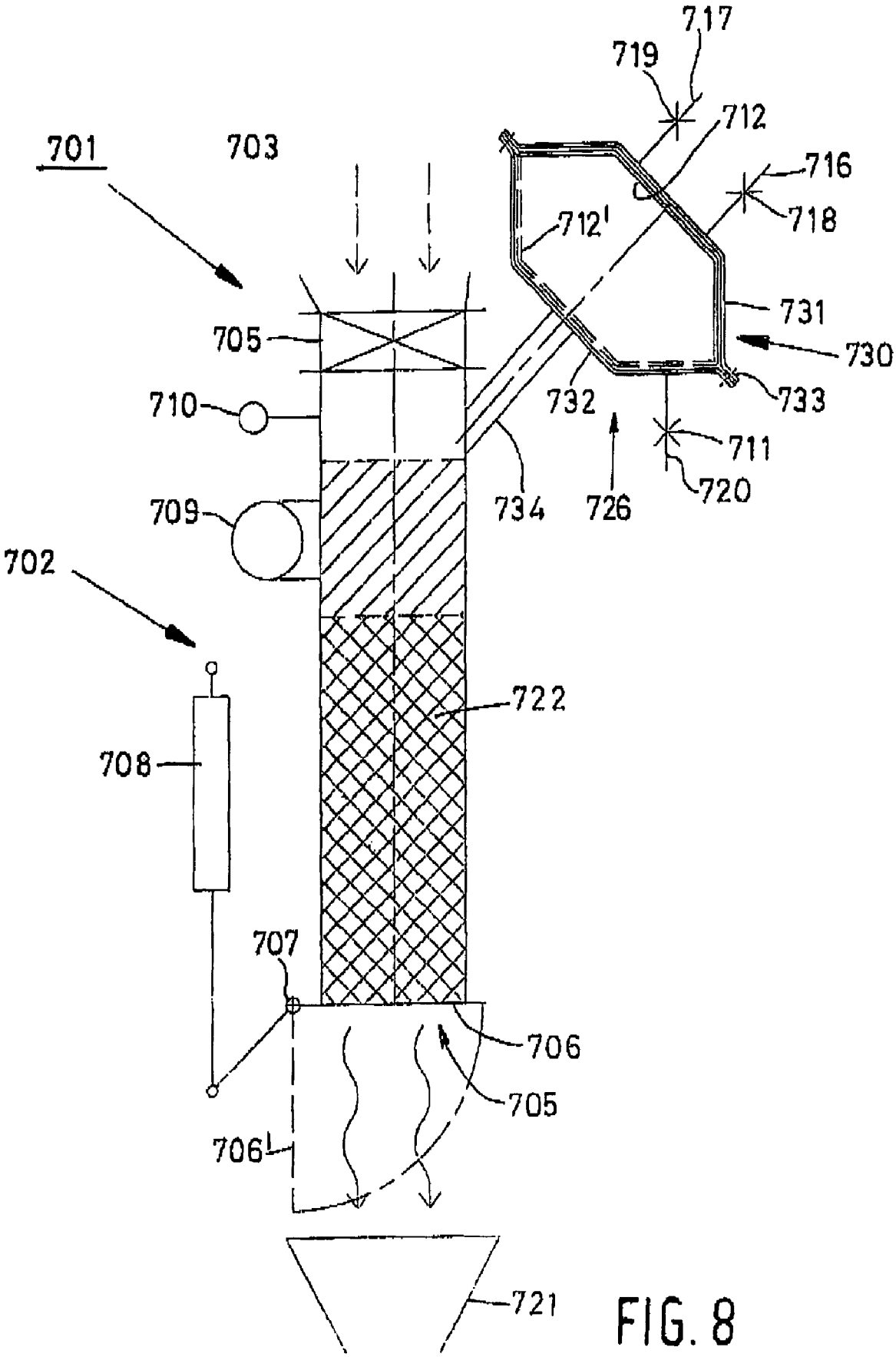
FIG. 8 is a schematic view showing another embodiment of the compacting device of the present invention.

The compacting device 701 that is shown in FIG. 8 is quite similar to the compacting device 201 that is shown in FIG. 3. For that reason, the reference numerals used in FIG. 8 correspond to the reference numerals used for the compacting device 201 of FIG. 3, augmented by 500. An important difference, however, is the manner in which the branch 726 is configured in comparison with the branch 226. The branch 726 comprises a cushion-shaped housing 730, which Is substantially built up of two cup-shaped plate members 731, 732, which are clamped together at the location of the circular flanged edge 733. A membrane 712 is present between the plate members 731, 732 at the location of said clamped connection. The space between the membrane 712 and the plate members 732 is connected to the interior of the housing 702 via the connecting line 734.

Starting from the situation in which the membrane 712 abuts against the plate member 731, the membrane 712 is moved to the position indicated at 712', in which the membrane 712 abuts against the inner side of the plate member 732 as a result of the pressure increase in the space between the membrane 712 and the plate member 731 that has been effected by supplying air to said space via the air supply line 717 in the open position of the shut-off valve 719 and the open position of the shut-off valve 711 in the discharge line 720 effected simultaneously therewith. After the position 712' has been reached, the shut-off valves 711 and 719 are closed and the shut-off valve 718 is opened, as a result of which a reduced pressure is created in the space between the membrane 712 and the plate member 731 via the vacuum line 716, causing the membrane 712 to return to the position in which it abuts against the inner side of the plate member 731. This results in a pressure decrease in the housing 702, thereby achieving the advantageous effects already described in connection with preceding preferred embodiments of compacting devices.

Figure 9:
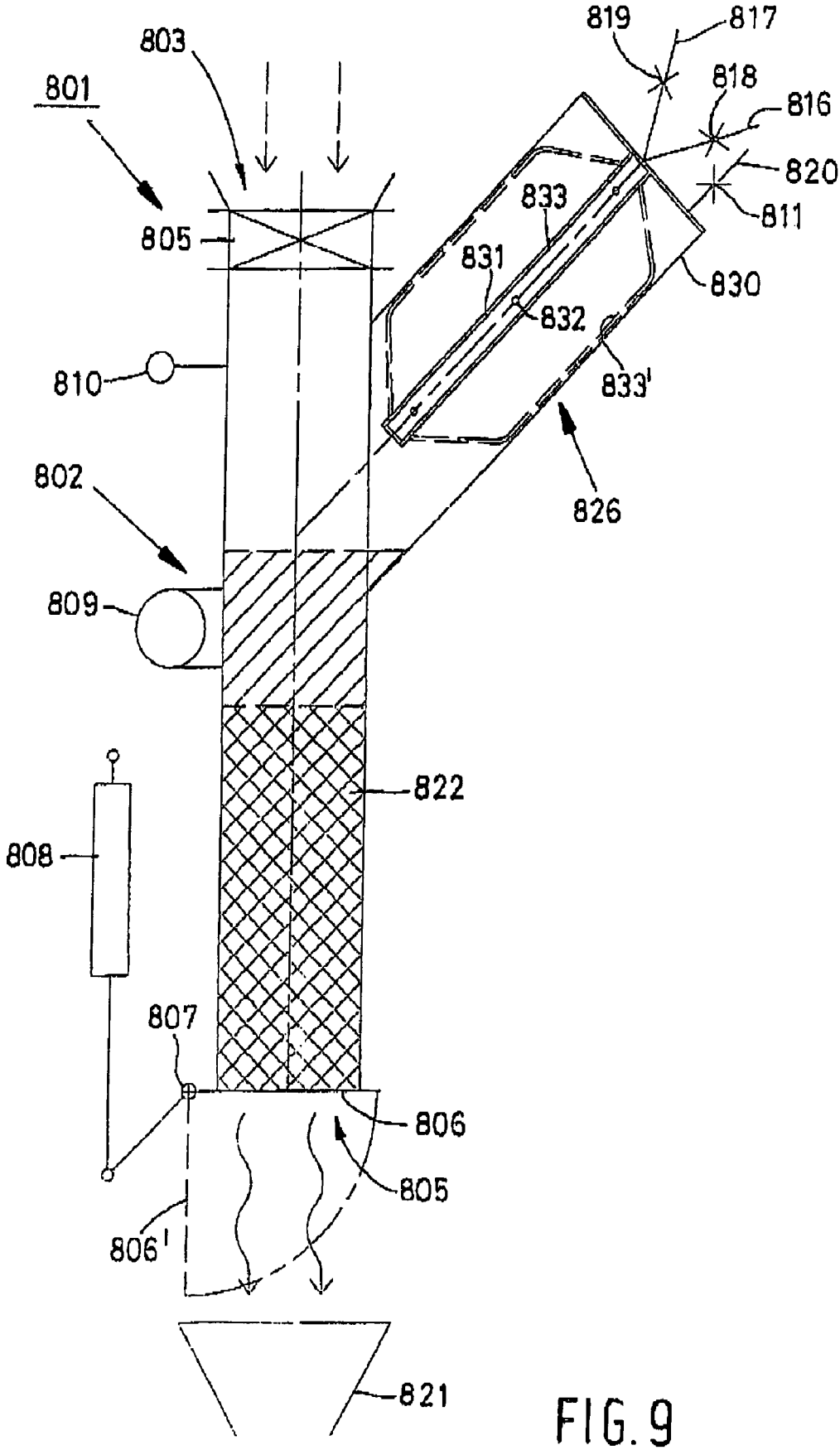
FIG. 9 is a schematic view showing another embodiment of the compacting device of the present invention.

Like the compacting device 701 of FIG. 8, the compacting device 801 of FIG. 9 is quite similar to the compacting device 201 of FIG. 3. Consequently, like parts are indicated by the same numerals as in the compacting device 201 of FIG. 3, augmented by 600. The essential difference is the configuration of the branch 826. The branch 826 comprises a tubular portion 830. An air tube 831 provided with air holes 832 extends within said portion 830, coaxially therewith. The air tube 831 is closed at its lower end, whilst at the upper end it is connected to an air supply line 817 provided with a shut-off valve 819 and an air supply line 816 provided with a shut-off valve 818. The air tube 831 is surrounded by a balloon 833 over substantially its entire length.

In the open position of the shut-off valve 811 in the air discharge line 820, the balloon 833 is inflated to a condition in which the balloon abuts against the inner side of the tubular part 830 (numeral 833') by supplying air via the air supply line 817 whilst the shut-off valve 819 is in its open position. As a result, air is expelled from the common space of the housing 802 and the tubular portion 830 via the air discharge line 820. After the shut-off valves 811 and 819 have been closed and the shut-off valve 818 in the vacuum line 816 has been opened, the balloon 833 is drawn back to its original position via the air holes 832, in which position it abuts against the air tube 831. Thus a reduced pressure is obtained within the housing 802, which has compacting effect on the material 822 to be compacted.

Figure 10C:
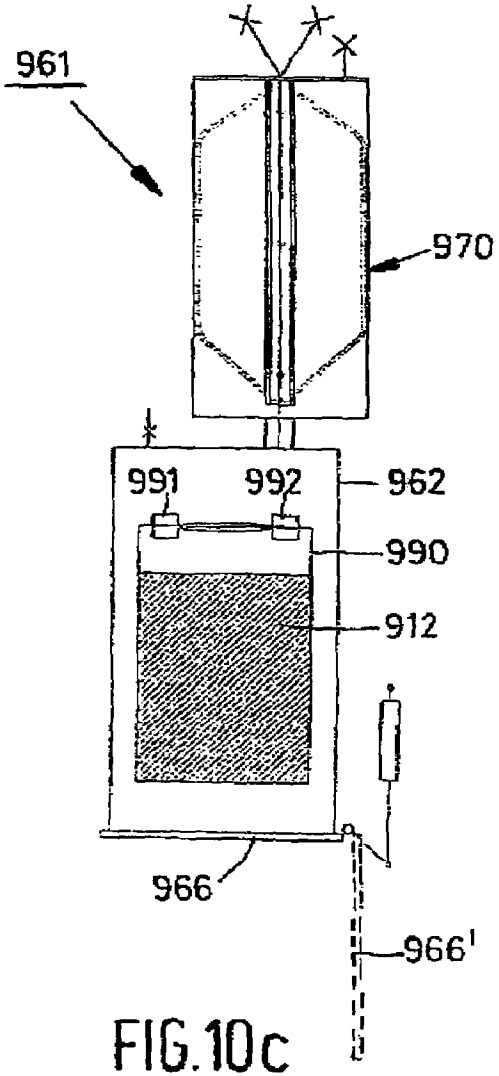
FIGS. 10*a-c* are schematic views showing other embodiments of the compacting device of the present invention.
Figure 10B:
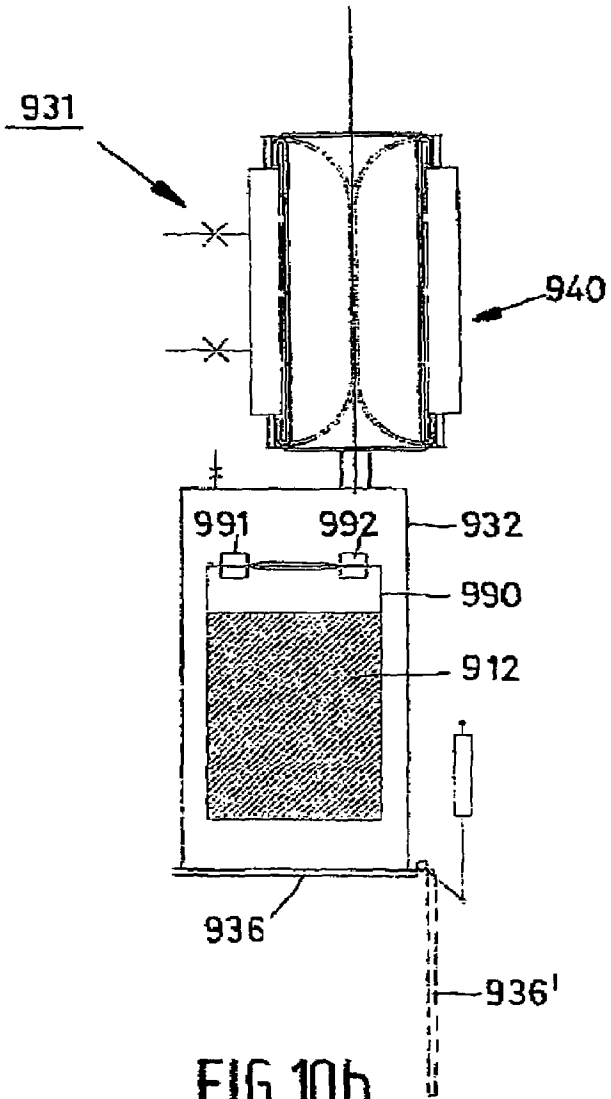
Figure 10A:
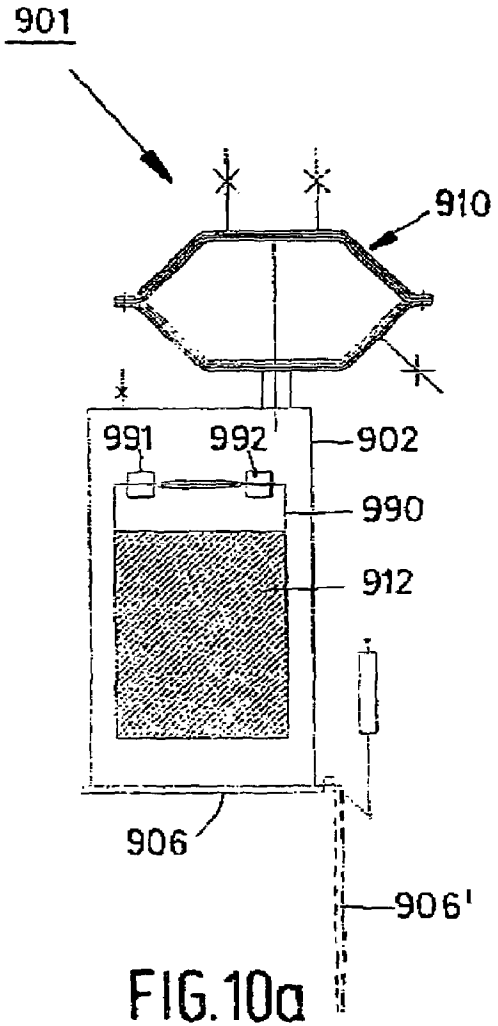

FIGS. 10*a*-10*c* show three important further preferred embodiments of a compacting device according to the invention. Said compacting devices 901, 931, 961 comprise chambers 902, 932, and 962, respectively, which can be shut off at the bottom side by means of valves 906, 936 and 966, respectively. In the open position of the bottom valves 906, 936, 966 (906', 936', 966') the open bottom side of the chambers 902, 932 and 962 forms a passage for introducing a bag 990 into the chamber 902, 932, 962 and for removing the bag 990 therefrom again. Gripping means 991, 992 are provided for placing/removing the bag 990 into/from the chambers 902, 932, 962, which gripping means engage the bag 990, which is still open, under the chambers 902, 932, 962 and subsequently pull it into the chambers 902, 932, 962 (in a manner not shown) in the open position of the bottom valves 906, 936, 966. Subsequently, the bottom valves 906, 936, 966 close, as a result of which the bag 990 containing powdery material is shut off from the environment of the housings 902, 932, 962. Connected to the housings 902, 932, 962 are pressure-reducing means 910, 940, 970, respectively, whose construction and operation has already been explained with respect to the preferred embodiments as shown in FIGS. 3, 8 and 9, respectively. Entrapped air in the bag 990 is removed to a significant extent by reducing the pressure inside the chambers 902, 932, 962 by means of the pressure-reducing means 910, 940, 970, which has a compacting effect on the powdery material 912 in the bag 990. After the valve 906 has been opened, the bag 990 is removed in downward direction from the chambers 902, 932, 962, after which the airtight bag 990 can be sealed hermetically by means of a sealing process.

Although in principle it is possible to use the compacting devices 901, 931, 961 with bags 990 containing a powdery material that has not been subjected to a compacting operation yet, it is preferable to use the compacting devices 901, 931, 961 with bags 990 whose contents 912 have been subjected to a prior compacting operation, for example, but not exclusively, by using a device as shown in FIGS. 1-9.

The scope of the present invention is not limited to the specific embodiments as described with reference to FIGS. 1-10, but it is to be determined by the content of the appended claims.

The invention claimed is:

1. A device for compacting a flowable solid material, comprising a compacting space provided with a supply opening for supplying material to be compacted to the compacting space and a discharge opening for discharging compacted material from the compacting space, closure means for effecting a gastight seal of the compacting space and pressure means for creating a reduced pressure inside the compacting space in the hermetically sealed condition of the compacting space, the pressure means including volume means for changing the volume of the compacting space.

2. The device according to claim 1, wherein the volume means comprise a wall of the compacting space that can move in a direction of movement towards and away from the interior of the compacting space.

3. The device according to claim 2, wherein said direction of movement is oriented perpendicularly to the direction of movement of the material between the supply opening and the discharge opening

4. The device according to claim 3, wherein the compacting space is at least substantially cylindrical in shape between the supply opening and the discharge opening, with the diameter of the cylindrical shape at the location of the movable wall being larger in an outer position of said movable wall than the diameter of another part of the cylindrical shape.

5. The device according to claim 3 or 4, wherein the movable wall is movable between an outer position and an inner position, in a direction perpendicular to the direction of movement of the material, over a distance of at least 25% of the dimension of the compacting space at the location of the movable wall.

6. The device according to claim 5, wherein the movable wall is movable from the outer position to the inner position to such an extent that the compacting space is shut off at least substantially completely at the location of the movable wall, in a plane perpendicular to the direction of movement of the material.

7. The device according to claim 2, wherein the movable wall comprises an elastic material.

8. The device according to claim 6, wherein said elastic material is a rubber.

9. The device according to claim 6, wherein said movable wall is endless.

10. The device according to claim 1, wherein the volume means comprise an element that can be inflated inside the compacting space.

11. The device according to claim 10, wherein the inflatable element can be inflated so that the circumference of the inflatable element abuts against walls of the compacting space.

12. The device according to claim 1, wherein the compacting space comprises a first part for accommodating the material to be compacted and a second part whose volume can be changed by the volume means.

13. The device according to claim 12, wherein the compacting space is provided with further closure means for realising a gastight seal between said first part and said second part.

14. A device for compacting a flowable solid material, comprising a compacting space provided with a supply opening for supplying material to be compacted to the compacting space and a discharge opening for discharging compacted material from the compacting space, closing means for effecting a gastight seal of the compacting space and pressure means for creating a reduced pressure inside the compacting space in the hermetically sealed condition of the compacting space, the compacting space having a first part for accommodating the material and a second part that can be sealed gastight from the first part by further closure means, in which second part the pressure can be reduced by the pressure means in the situation in which the second part is sealed gastight from the first part by the closure means.

15. The device according to claim 12 or 14, wherein the second part forms a passage for material to be compacted moving from the supply opening to the first part.

16. The device according to claim 12 or 14, wherein the second part forms at least one branch of the compacting space insofar as it extends between the supply opening and the discharge opening.

17. The device according to claim 12 or 14, wherein the second part is present on the side of the first part that faces towards the discharge opening.

18. A method for using a device according to the first aspect of the invention, comprising the steps of:

A filling the compacting space with a flowable solid material to be compacted via the supply opening, B reducing the volume of the compacting space by making use of the volume means, C sealing the compacting space gastight by making use of the closure means, D enlarging the volume of the compacting space in the situation in which said compacting space is sealed gastight, thus reducing the pressure in the compacting space, E discharging the compacted flowable solid material from the compacting space via the discharge opening.

19. The method according to claim 18, comprising the step of admitting air into the compacting space, which step is carried out between steps D and E, for the purpose of increasing the pressure in the compacting space.

20. The method according to claim 18 or 19, wherein the volume of the material to be compacted is maximally 50% of the volume of the compacting space.

21. The method according to claim 18, wherein the material to be compacted is charged into a bag in the compacting space during step A.

* * * * *